US008387786B2

(12) United States Patent
Fontana

(10) Patent No.: US 8,387,786 B2
(45) **Date of Patent: *Mar. 5, 2013**

(54) PACKAGING FOR EXTEMPORANEOUS PRODUCTS, PARTICULARLY MEDICINAL, PHARMACEUTICAL, COSMETIC PRODUCTS AND THE LIKE

(75) Inventor: Antonio Fontana, Carpi (IT)

(73) Assignee: Lameplast S.p.A., Novi di Modena (IT)

( * ) Notice: Subject to any disclaimer, the term of this patent is extended or adjusted under 35 U.S.C. 154(b) by 853 days.

This patent is subject to a terminal disclaimer.

(21) Appl. No.: 11/886,034

(22) PCT Filed: Mar. 15, 2006

(86) PCT No.: PCT/IB2006/000572

§ 371 (c)(1),
(2), (4) Date: Mar. 29, 2010

(87) PCT Pub. No.: WO2006/097823

PCT Pub. Date: Sep. 21, 2006

(65) Prior Publication Data

US 2010/0276429 A1 Nov. 4, 2010

(30) Foreign Application Priority Data

Mar. 15, 2005 (IT) ..... MO2005A0058

(51) Int. Cl.
*B65D 25/08* (2006.01)

(52) U.S. Cl. ..... 206/221; 206/219; 215/DIG. 8

(58) Field of Classification Search ..... 206/219, 206/221, 222, 568; 220/502; 215/6, DIG. 8
See application file for complete search history.

(56) References Cited

U.S. PATENT DOCUMENTS

| | | | | |
|---|---|---|---|---|
| 3,156,369 | A | 11/1964 | Bowes et al. | |
| 3,924,741 | A * | 12/1975 | Kachur et al. | 206/221 |
| 4,024,952 | A * | 5/1977 | Leitz | 206/221 |
| 4,865,189 | A | 9/1989 | Guerra et al. | |
| 4,947,986 | A * | 8/1990 | Ballu | 206/221 |
| 4,982,875 | A * | 1/1991 | Pozzi et al. | 222/83 |
| 5,217,433 | A | 6/1993 | Bunin | |
| 5,388,690 | A * | 2/1995 | Mutterle et al. | 206/222 |

(Continued)

FOREIGN PATENT DOCUMENTS

JP 2000128251 5/2000

OTHER PUBLICATIONS

English abstract of JP2000128251, May 2000.

*Primary Examiner* — David Fidei
(74) *Attorney, Agent, or Firm* — Dykema Gossett PLLC

(57) ABSTRACT

The packaging for extemporaneous products, particularly medicinal, pharmaceutical, cosmetic products and the like, comprises a container (2) of a first substance which extends into a neck (4), a mouth (5) defined at the top of neck turned towards the outside of the container, a receptacle (6) of a second substance which is at least partially housed in said neck and a tubular body (7) with its end turned towards the inside of the container closed by a bottom and the opposite open end and which features at least one window (10) defined in its side walls, the receptacle being fitted axially sliding in the neck between a containment configuration of the second substance, in which it is retracted in the neck, and a release configuration of the second substance, in which it is at least partially protracted beyond the end of the neck turned towards the inside of the container with the window at least partially uncovered.

22 Claims, 6 Drawing Sheets

U.S. PATENT DOCUMENTS 5,419,445 A * 5/1995 Kaesemeyer ..... 215/11.1
5,927,549 A * 7/1999 Wood ..... 222/83
5,967,309 A * 10/1999 Robles-Gonzalez et al. . 206/221
6,003,728 A * 12/1999 Elliott ..... 222/81
6,148,996 A * 11/2000 Morini ..... 206/222
6,257,463 B1 * 7/2001 De Polo ..... 222/525
6,435,341 B1 * 8/2002 Nobbio ..... 206/219
7,503,453 B2 * 3/2009 Cronin et al. ..... 206/221
7,546,919 B2 * 6/2009 Lee ..... 206/221
7,870,952 B2 * 1/2011 Fontana ..... 206/222
2002/0030056 A1 * 3/2002 Hsu ..... 220/505
2003/0213709 A1 * 11/2003 Gibler et al. ..... 206/219
2004/0159562 A1 * 8/2004 Takahashi et al. ..... 206/219

* cited by examiner

PACKAGING FOR EXTEMPORANEOUS PRODUCTS, PARTICULARLY MEDICINAL, PHARMACEUTICAL, COSMETIC PRODUCTS AND THE LIKE

TECHNICAL FIELD

The object of this invention is a packaging for extemporaneous products, particularly medicinal, pharmaceutical, cosmetic products and the like.

BACKGROUND ART

A number of extemporaneous products, meaning products consisting of the solution or mixture of at least two different substances, of which, for instance, one in liquid state and the other in powder state, which are kept separate from each other until they are used, are known in the medicinal sector, the pharmaceutical sector and the cosmetic sector.

For such extemporaneous products, packagings are known essentially consisting of a container closed on the bottom and which extends at the top into a neck, at the top of which a mouth is defined; inside the container, a first substance is contained, generally in liquid state.

In the mouth of the container, a receptacle of a second substance is housed and consists of a hollow cylinder-shaped body, closed at the bottom by a breakable bottom and open at the top; the bottom of the receptacle, as long as this remains intact, separates the second substance from the first.

Inside the receptacle, a cutting element is sealed consisting of a tubular body, the bottom end of which is sectioned according to an oblique plane or shaped like the beak of a flute, the upper end of which extends beyond the upper end of the receptacle. The cutting element slides axially compared to the receptacle between a non-interference configuration, in which it is placed above the intact bottom of the receptacle, and a cutting configuration, in which, pushed towards the bottom of the receptacle, it cuts the receptacle along the surrounding edge thereby placing the thus-opened receptacle in communication with the container.

The known packagings also feature a cover cap associated with the container neck by means of a threaded coupling; the lower edge of the cap is temporarily fastened, along a breakage line, to a seal ring fastened to the container neck.

When the time comes to use the product, the cap is screwed onto the neck of the container; by lacerating the breakage line, the cap is thus released from the seal ring.

The screwing up of the cap causes the sliding of the cutting element inside the receptacle until the bottom of this is cut; the second substance thus pours from the receptacle into the container inside which it mixes with the first substance, forming the product.

To dispense the product thus formed, the cap simply has to be unscrewed and the cutting element and, possibly, the open receptacle have to be extracted to release the container dispenser mouth.

These known type packagings are not free from drawbacks, including the fact that they are fairly complicated, both in terms of their structure and their construction; they do in fact require the design, production and assembly of numerous component parts: the container, the receptacle, the cutting element and the cap.

The production and the assembly of so many component parts calls for an extensive amount of time and very high production costs, as well as the use of considerable quantities of construction materials.

DISCLOSURE OF THE INVENTION

The aim of the present invention is to eliminate the above-indicated drawbacks of the known packagings by providing a packaging for extemporaneous products, particularly medicinal, pharmaceutical, cosmetic products and the like, whose structure and construction are easier and requiring the design, production and assembly of less component parts.

The object of the present invention consists in inventing a packaging whose production costs and time are reasonable, easy to assemble and permitting to reduce the quantities of construction materials used for manufacturing.

Another object of the present invention consists in inventing a packaging that can be easily and conveniently used and opened by users without any special effort on their part.

Within such technical aim, another object of the present invention is to cater for the previous aim with a simple structure, of relatively easy practical implementation, safe and effective to use and work, as well as having a fairly low cost.

This aim and these objects are all achieved by the present packaging for extemporaneous products, particularly medicinal, pharmaceutical, cosmetic products and the like, comprising a container of a first substance which extends into a neck, a mouth defined at the end of the neck turned towards the outside of the container and a receptacle containing a second substance which is at least partially housed in said neck, the inner volume of the receptacle being temporarily separated from the inner volume of the container and adapted to be placed in communication with it for mixing the first and the second substance to form a product, characterized in that said receptacle comprises a tubular body which have an end, turned towards the inside of said container and closed by a bottom, and an opposite open end, and which is provided with at least one window defined in its side walls, said receptacle being fitted axially sliding in said neck between a containment configuration of the second substance, in which it is retracted in said neck, which closes said window, and a release configuration of the second substance, in which it is at least partially protracted beyond the end of the neck turned towards the inside of the container with said window at least partially uncovered to allow the fall of the second substance in the container.

BRIEF DESCRIPTION OF THE DRAWINGS

Further characteristics and advantages of the present invention will appear even more evident from the detailed description of some preferred, but not exclusive, embodiments of a packaging for extemporaneous products, particularly medicinal, pharmaceutical, cosmetic products and the like, illustrated by way of non limiting example in the accompanying drawings, wherein.

WAYS OF CARRYING OUT THE INVENTION

Figure 1:
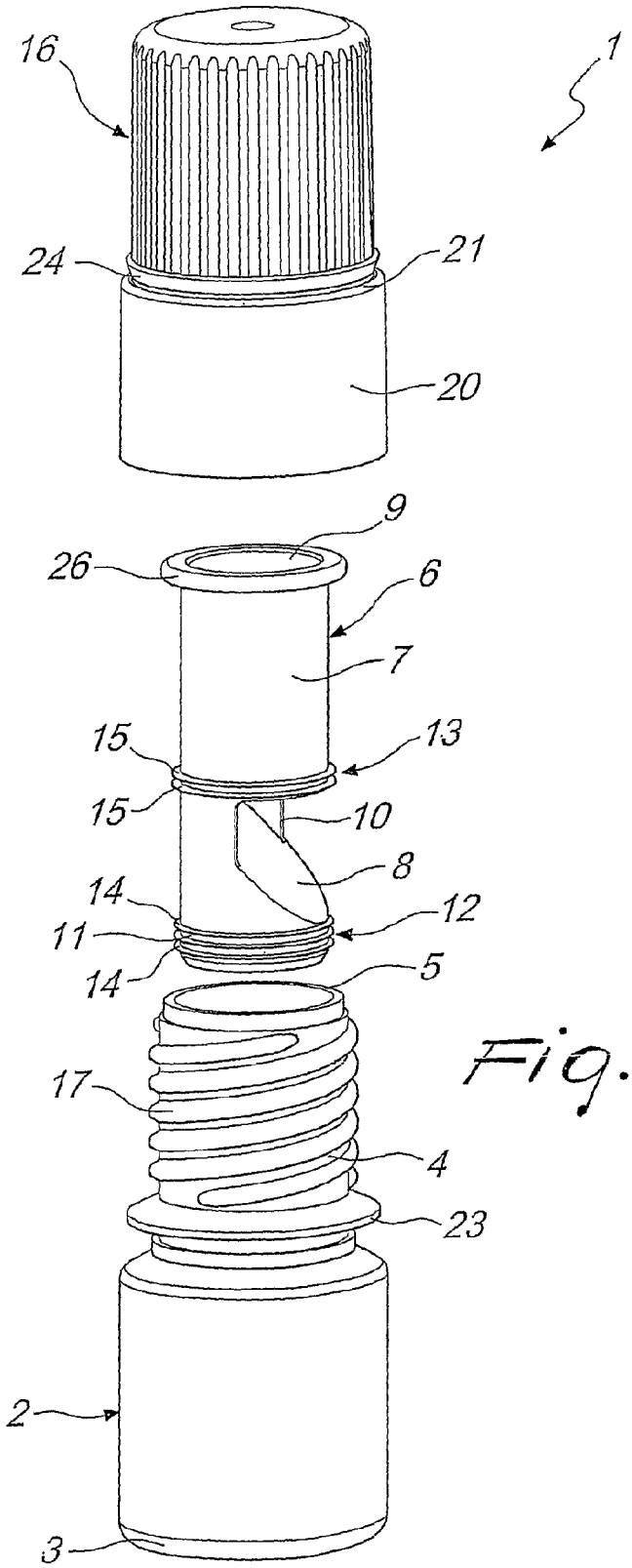
FIG. 1 is an axonometric and exploded view of a first embodiment of the packaging according to the invention in which the receptacle can be removed from the container independently and subsequently to the cap.

With special reference to such figures, the reference numeral 1 generally designates a packaging for extemporaneous products, particularly medicinal, pharmaceutical, cosmetic products and the like.

By extemporaneous products is meant products obtainable by the solution or mixing of at least two different substances that are kept separate until the product is used. One of the two substances, the solute, is generally in powder or granular form, while the other, the solvent, is generally in liquid form; other different cases cannot however be excluded in which both substances are in powder or granular or liquid form.

The packaging 1 comprises a container 2 of a first substance having substantially the shape of a phial or a bottle closed below by a base 3 and which extends, on the opposite side, in a neck 4 at the end of which a mouth 5 is defined turned towards the outside of the container 2.

In the neck 4 is at least partially housed a receptacle 6 of a second substance; the inner volume 6*a* of the receptacle 6 is temporarily separated from the inner volume 2*a* of the container 2 and is adapted to be placed in communication with it to mix the first and the second substances to form the product.

The receptacle 6 consists of a tubular body 7 with an end turned towards the inside of the container 2, which is closed by a bottom 8, and an opposite end 9, which is open and extends beyond the mouth 5; on the side walls of the tubular body 7 at least one window 10 is defined.

In a preferred form of embodiment the tubular body 7 is substantially cylinder-shaped and with a substantially constant orthogonal section.

The bottom 8 rests on a plane which is inclined with respect to the axis of the tubular body 7, the window 10 having a side extending along a section of the perimeter of the bottom 8 comprising the point of the bottom 8 least distant with respect to the surface of container 2 opposite it, meaning with respect to base 3.

In a possible form of embodiment, the bottom 8 extends, on the opposite side compared to the tubular body 7, in a tubular shell 11, this too being preferably substantially cylindrical.

Figure 3:
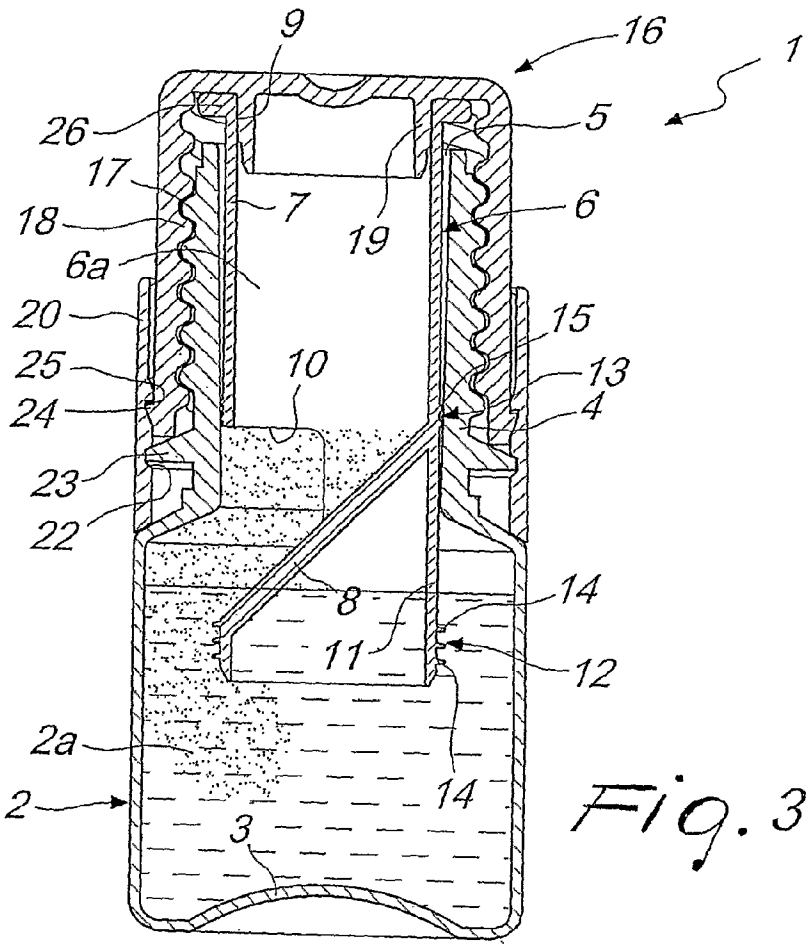
FIG. 3 is a section view of the packaging of FIG. 1 closed after the preparation of the product.
Figure 2:
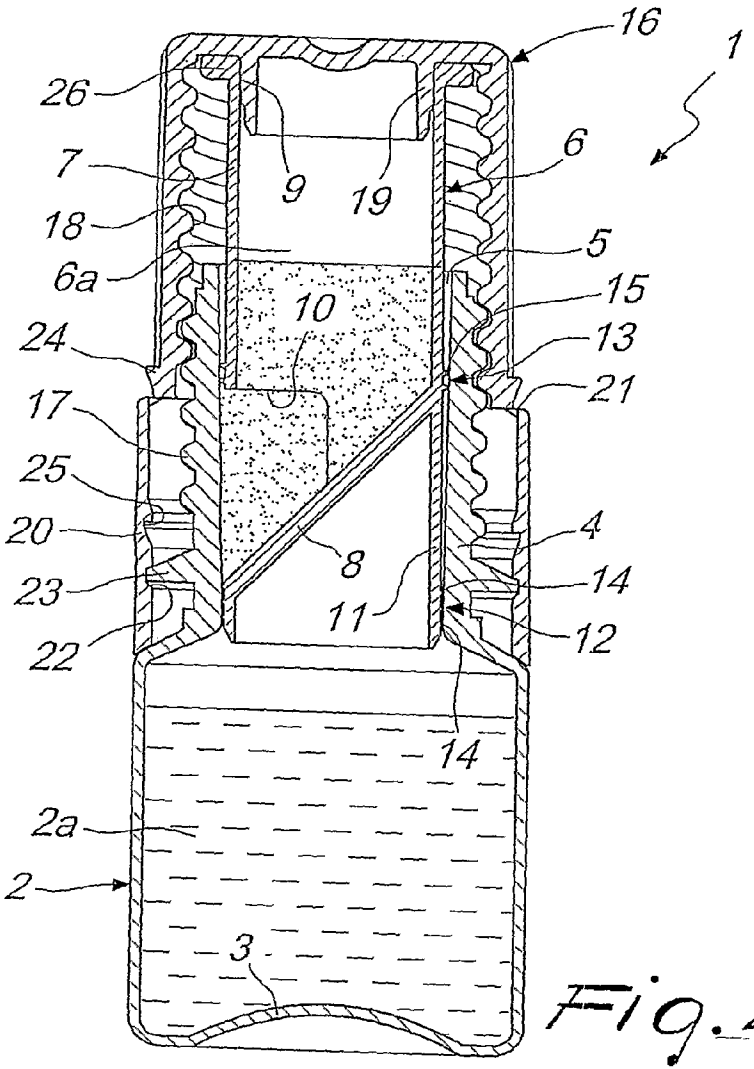
FIG. 2 is a section view of the packaging of FIG. 1 closed before the preparation of the product.
Figure 6:
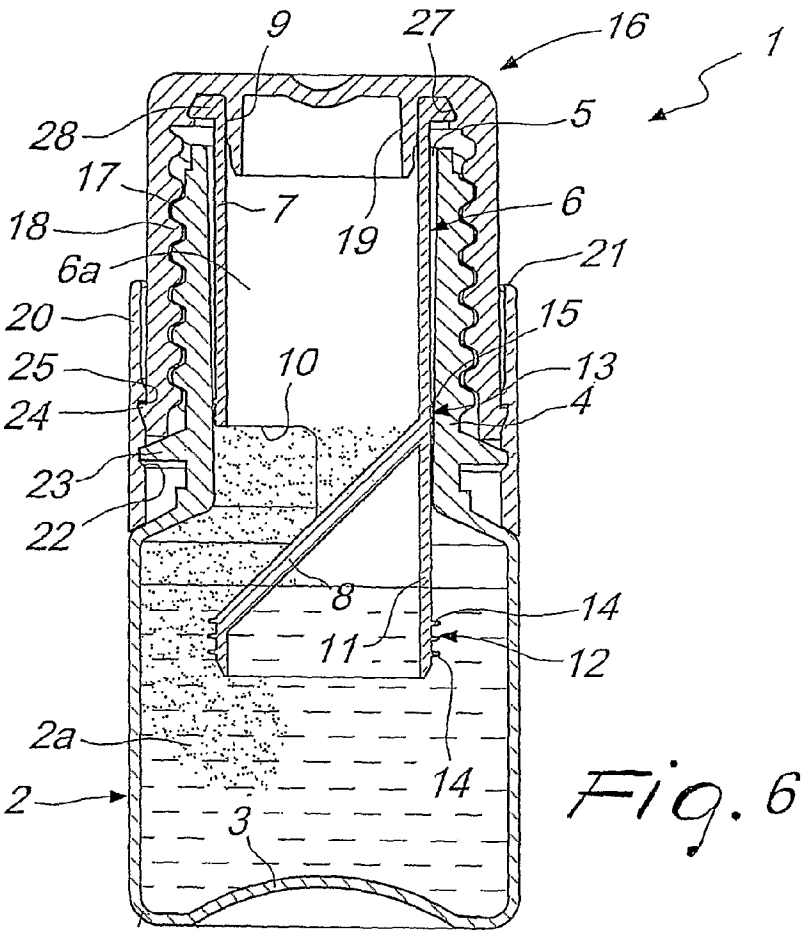
FIG. 6 is a section view of the packaging of FIG. 4 closed after the preparation of the product.
Figure 5:
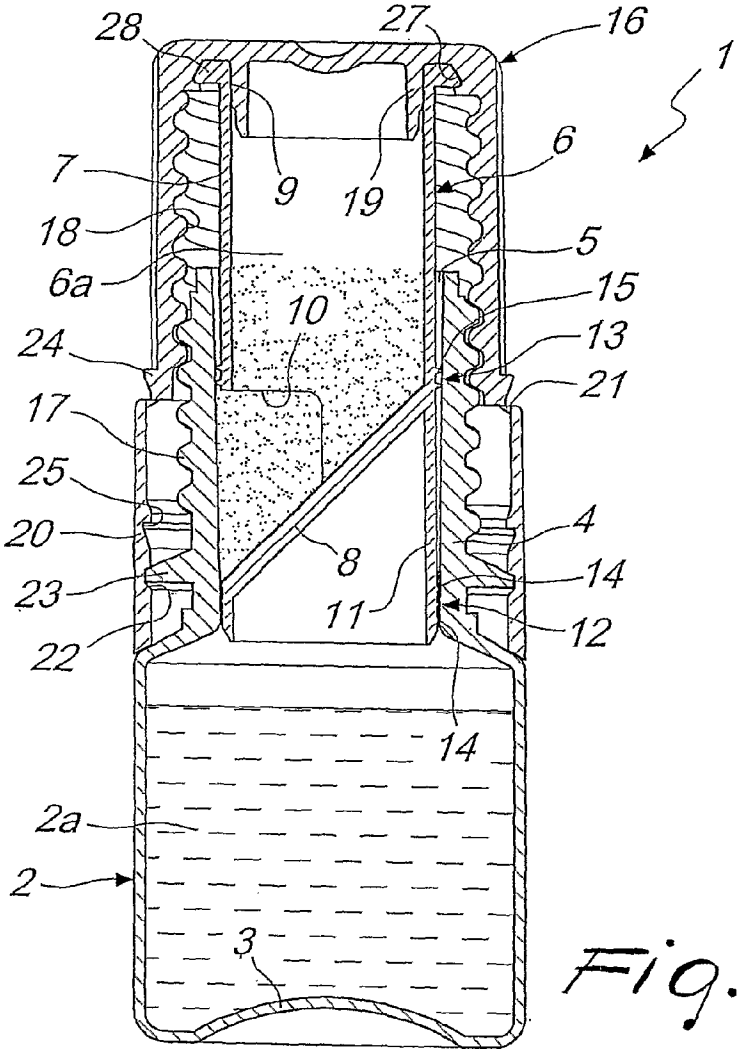
FIG. 5 is a section view of the packaging of FIG. 4 closed before the preparation of the product.
Figure 9:
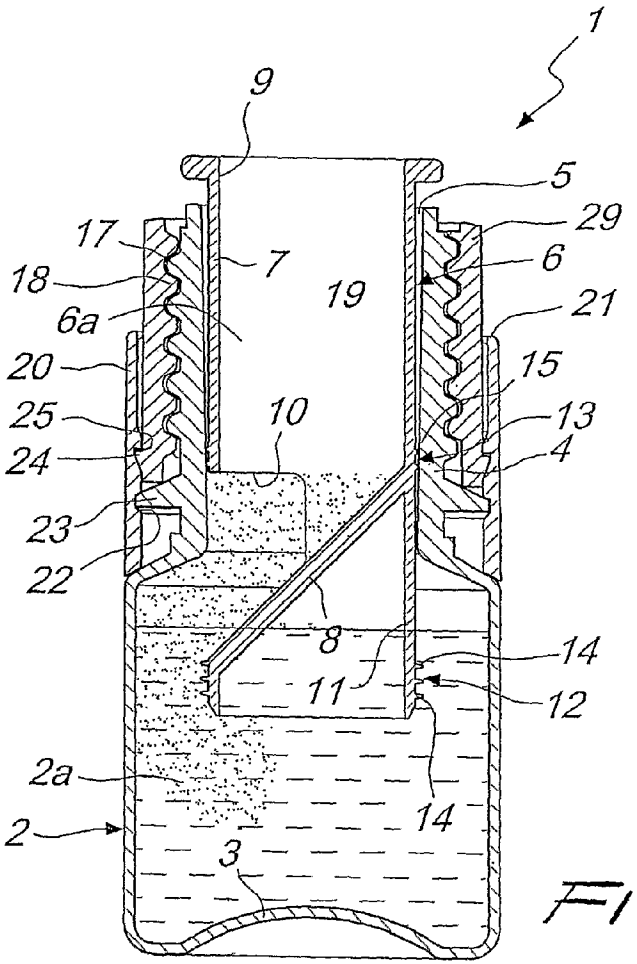
FIG. 9 is a section view of the packaging of FIG. 7 closed after the preparation of the product, the top of the cap being removed.
Figure 8:
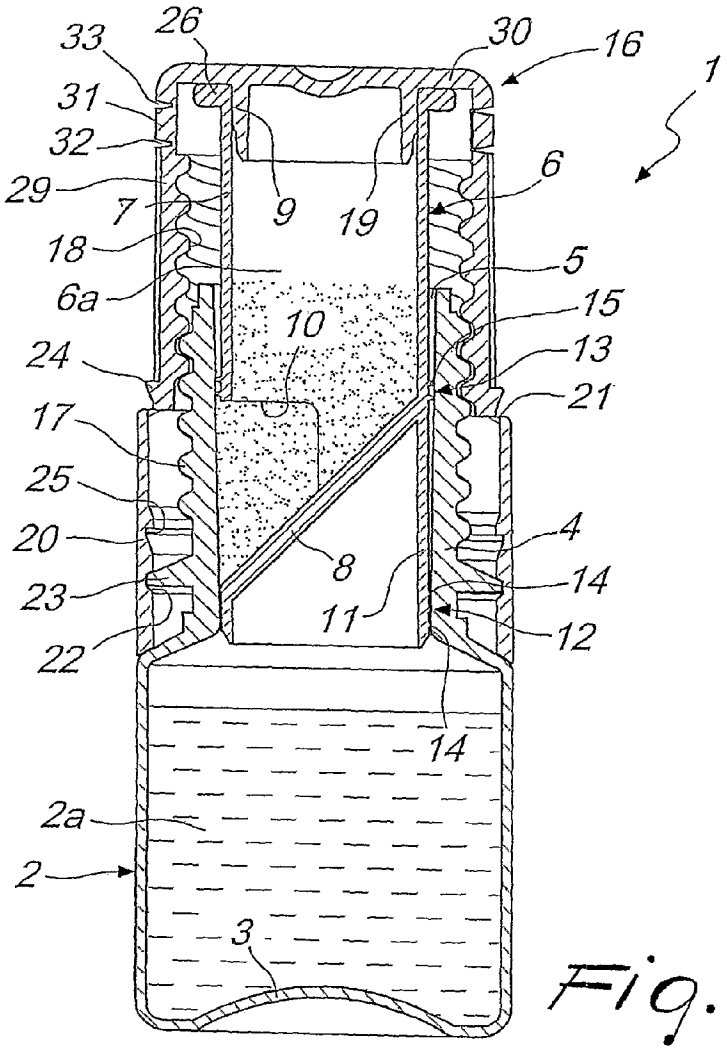
FIG. 8 is a section view of the packaging of FIG. 7 closed before preparation of the product.

The receptacle 6 is fitted axially sliding in the neck 4 between a containment configuration of the second substance (FIGS. 2, 5 and 8) and a release configuration of the second substance inside the container 2 where it mixes with the first substance contained in it (FIGS. 3, 6 and 9).

In the containment configuration, the receptacle 6 is retracted in the neck 4 with the bottom 8 generally at a height, compared to the base 3, greater than that of the end of the neck 4 turned towards the inside of the container 2; the walls of the neck 4 thereby close the window 10, withholding the second substance inside the tubular body 7.

In the release configuration, the receptacle 6 is at least partially protracted beyond the end of the neck 4 turned towards the inside of the container 2, meaning with at least a portion of the bottom 8 at a height, compared to the base 3, lower than that of the end of the neck 4 turned towards the inside of the container 2; in this configuration the window 10 is at least in part uncovered, so the second substance contained in the tubular body 7 falls into container 2 where it mixes with the first substance.

The fall of the second substance is favoured by the sloping of the bottom 8 which acts as a sliding plane.

Usefully, in the containment configuration, the bottom 8 acts as an isolating element of the second substance from the vapours generated by the first substance, thus preventing the second substance, by absorbing said vapours, from thickening into agglomerates that are hard to dissolve.

The packaging 1 is also provided with temporary retention means 12 of the receptacle 6 in the containment configuration and temporary blocking means 13 of the receptacle 6 in the release configuration.

In a possible form of embodiment, the temporary retention means 12 comprise one or more first protruding pieces, like first fins 14, teeth or similar, which are defined as overhanging on the outer side surface of the tubular body 7 or of the tubular shell 11, that extend along a plane transversal to the longitudinal axis of the receptacle 6 and which have a preferably ring shape. The first fins 14 are adapted to interfere with the inner side surface of the neck 4 and yield by flexing following the sliding of the receptacle 6 in the neck 4 itself.

In the forms of embodiment shown, the temporary retention means 12 comprise a plurality of first fins 14 defined in the tubular shell 11; alternative forms of the temporary retention means 12 cannot however be excluded.

The temporary blocking means 13, in turn, can consist, for example, of one or more second protrusions, like second fins 15, teeth or similar, which are defined as overhanging on the outer side surface of the tubular body 7, which extend along a plane transversal to the longitudinal axis of receptacle 6 and which preferably have a ring shape. The second fins 15 are adapted to interfere with the inner side surface of the neck 4 and yield by flexing following the sliding of receptacle 6 in the neck 4. In the forms of embodiment shown the temporary blocking means 13 comprise a plurality of second fins 15 defined in the tubular body 7 above the window 10; alternative forms of the temporary blocking means 13 cannot however be excluded.

Usefully, the inner side surface of the neck 4 has a truncated cone shape that converges towards the inside of the container 2 to cooperate both with the temporary retention means 12 and with the temporary blocking means 13.

Packaging 1 also comprises a removable cap 16 that covers the mouth 5 and which is associated with the neck 4 of the container 2 with the threaded coupling consisting of an outer thread 17, defined on the outer side surface of the neck 4, and by an inner thread 18, defined on the inner side surface of the cap 16.

The inner surface of the crown of the cap 16 is associated at the open end 9 of the receptacle 6; more specifically, from the inner surface of the crown of the cap 16 an appendix 19 extends which fits in the open end 9 of receptacle 6. Following the screwing up of the cap 16 on the neck 4, the appendix 19 exercises a thrust on the receptacle 6 such as to cause its sliding from the containment configuration to the release configuration.

The cap 16 also comprises a seal ring 20 temporarily fastened to it along a breakable line 21, consisting, for example, of a plurality of breakable bridges, and which is associated with the container 2. More specifically, the seal ring 20 comprises a ring-shaped groove 22 that couples by slotting into a collar 23 which protrudes from the outer side surface of the neck 4.

The seal ring 20 has an inner diameter greater than the outer diameter of the cap 16, between the seal ring 20 and the cap 16 a fixing coupling being defined able to slot in once the cap is completely screwed up. Such fixing coupling can comprise, for instance, a raised part 24, preferably ring-shaped, which is defined as protruding from the outer side surface of the cap 16 and a corresponding groove 25, also ring-shaped, defined inside the seal ring 20, or vice versa.

The cap 16 is integrally produced in a single body with the seal ring 20, and its outer side surface is furthermore usefully knurled for better grip.

In the first form of embodiment (FIGS. 1-3), the receptacle 6 comprises a handgrip 26 defined on its outer side surface and near to its open end 9. In this first form of embodiment, the removal of the cap 16 occurs before and independently from that of the receptacle 6.

Figure 4:
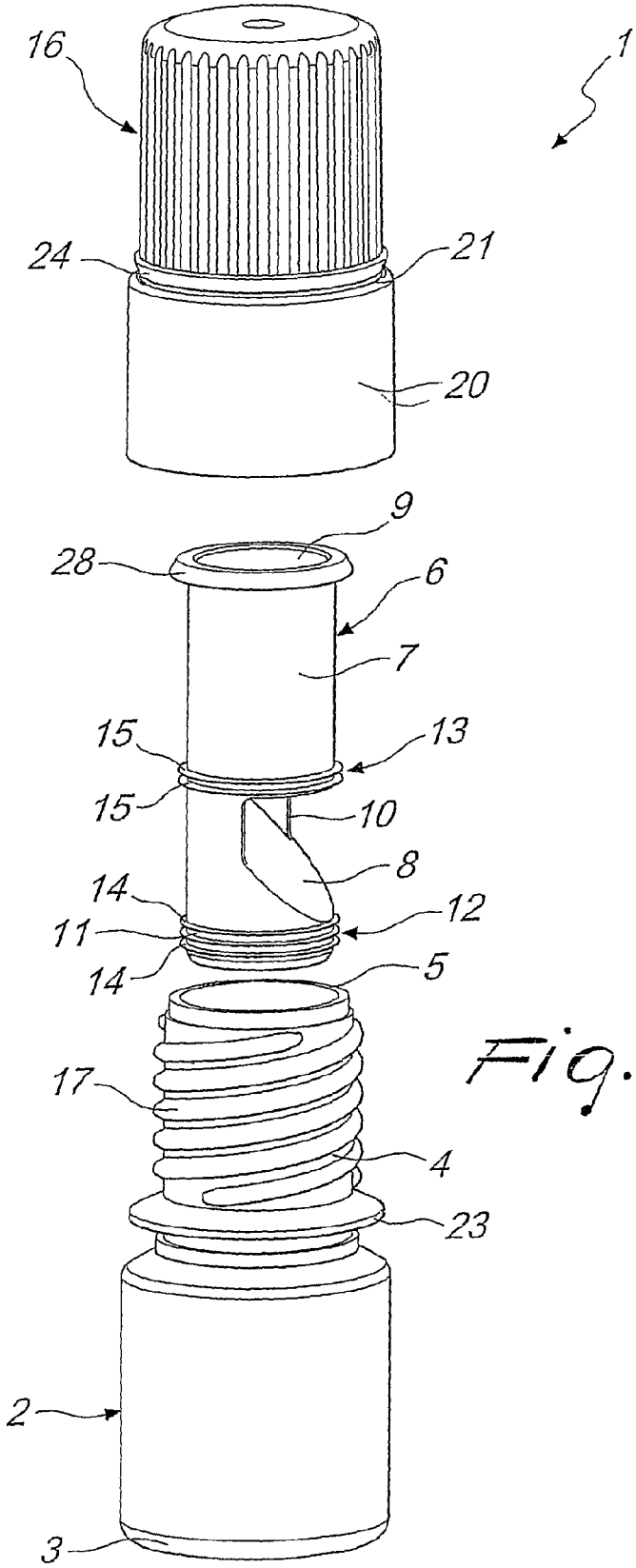
FIG. 4 is an axonometric and exploded view of a second embodiment of the packaging according to the invention in which the receptacle can be removed from the container integrally with and at the same time as the cap.

In the second form of embodiment (FIGS. 4-6), the cap 16 comprises an inner cavity 27 which couples by fixing into a corresponding fastening tooth 28 defined as protruding near the open end 9 of the receptacle 6 making the latter integral with the cap 16; the removal of the receptacle 6 therefore occurs integrally and at the same time as that of the cap 16.

It should be noted that in the first and second form of embodiment, the seal ring 20 is removed together with the cap 16, the coupling between the raised part 24 and the groove 25 being in fact more stable than that between the groove 22 and the collar 23 which, on the other hand, yields.

Figure 7:
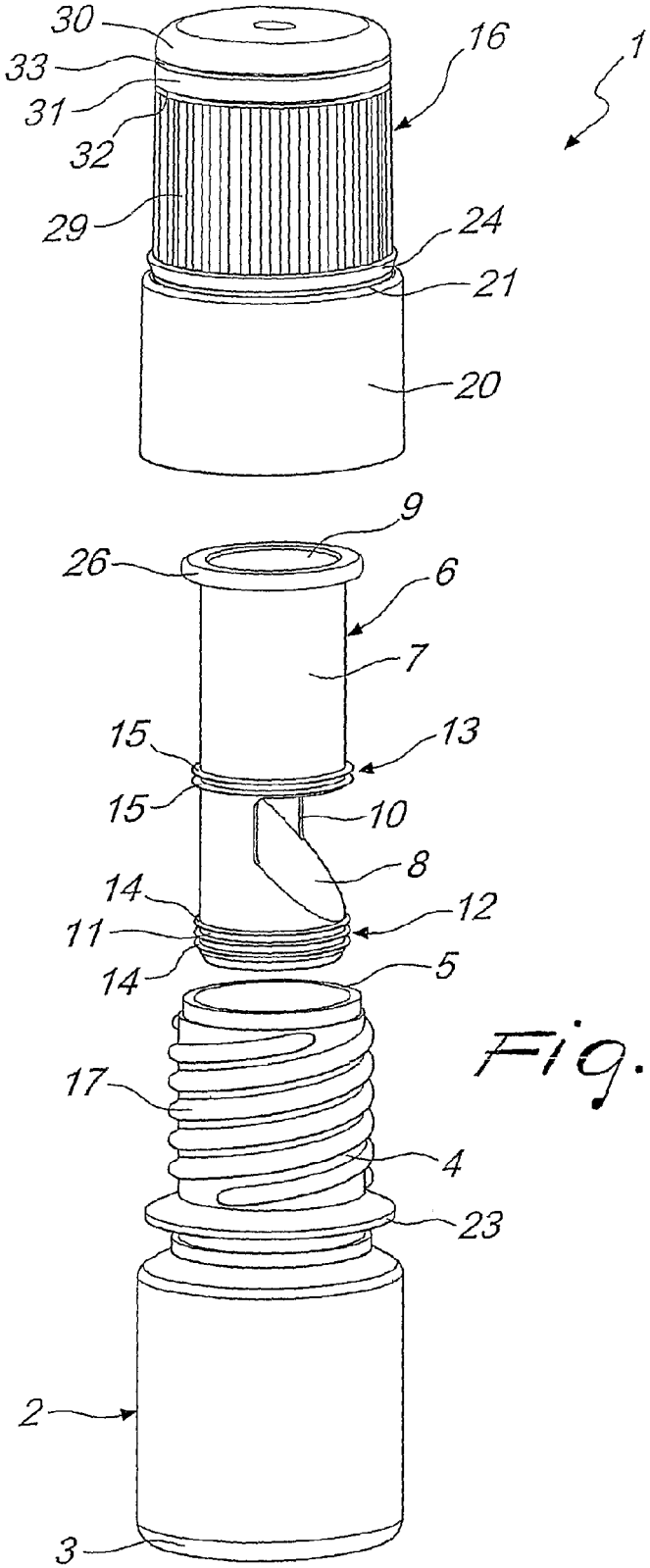
FIG. 7 is an axonometric and exploded view of a third embodiment of the packaging according to the invention, with cap split into a liner and a top, the removal of the receptacle of the container being independent and subsequent to that of the top of the cap.

In the third form of embodiment (FIGS. 7-9), the cap 16 is split into a liner 29, substantially cylindrical, open at the opposite ends and able to externally embrace the neck 4, and into a top 30, which defines the crown of the cap 16 and which is temporarily fastened to the surrounding edge of an end of the liner 29 with in between a band 31 of the removable type. The opposite edges of the band 31 are associated with the surrounding edge of the liner 29 and with the corresponding edge of the top 30 along respectively weakened lines, 32 and 33.

The raised part 24, which couples with the groove 25 of the seal ring 20, is defined in the liner 29; inside the liner 29, to which the seal ring 20 is temporarily fastened, is also defined the inner threading 18.

In this third form of embodiment, once the screwing up of the cap 16 on the neck 4 has been completed, the band 31 is eliminated to remove the top 30 only, while the liner 29, coupled with the ring 20 remains fastened to the neck 4; the removal of the receptacle 6 occurs after that of the top 30, the receptacle featuring the handgrip 26 in this case too.

The operation of the invention is the following.

The assembly of the packaging 1 is done by inserting a preset quantity of the first substance in the container 2 in the neck 4 of which the receptacle 6 is subsequently fitted and withheld in the containment configuration by the temporary retention means 12.

Through the open end 9 of the receptacle 6, a preset quantity of the second substance is introduced inside it.

Afterwards, the cap 16, integral in just one body with the seal ring 20, is fitted on the neck 4, its appendix 19 fitting into the open end 9 of the receptacle 6 and the groove 22 inside the seal ring 20 coupling with the collar 23.

To prepare the product obtainable by mixing the first and second substances, the cap 16 will have to be screwed onto the neck 4, thereby breaking the breakable line 21 and separating it from the seal ring 20.

During the screwing up of the cap 16, its appendix 19 exercises an axial thrust on the receptacle 6 such as to cause it to slide, by contrast to the action exercised by the temporary retention means 12 (first fins 14), from the containment configuration to the release configuration of the second substance.

In this last configuration, the second substance, facilitated by the slope of the bottom 8 and the conformation of the window 10, runs into the container 2 where it mixes with the first substance thus forming the product.

At the end of the screwing up process of the cap 16 on the neck 4, the raised part 24 couples in the groove 25, and the seal ring 20 is thus fastened to the cap 16 or to its liner 29.

To dispense the thus-formed product, the cap 16 and the receptacle 6 will have to be removed, so as to open the mouth 5.

In the first form of embodiment, the cap 16, together with the seal ring 20 fastened to it, is removed before and separately from the receptacle 6.

In the second form of embodiment, the receptacle 6 is removed integral with and at the same time as the cap 16 and the seal ring 20 fastened to it, thanks to the coupling between the fastening tooth 28 and the inner cavity 27.

In the third form of embodiment, only the top 30 of the cap 16 is removed, the liner 29 of which, integral with the seal ring 20, remains fastened to the neck 4; the receptacle 6 is subsequently removed.

In practice, it has been found that the described invention achieves the intended aim and objects.

The packaging according to the invention is in fact of simpler structure and construction compared to the known packagings, and does in fact comprise fewer component parts and, more specifically, is without the cutting element.

The packaging according to the invention therefore has lower production costs and takes less time to make compared to the known packagings and requires the use of less construction materials.

The packaging according to the invention also permits isolating the second substance from the first until the time comes to prepare the product; in the packaging according to the invention it is in fact possible to increase the thickness of the bottom of the receptacle, something not feasible in the case of known packagings, where the bottom of the receptacle, being of the breakable type, must be of reduced thickness. The packaging according to the invention thus prevents a substance absorbing the vapours released by the other substance and prevents the formation of thickenings and agglomerates and guarantees the complete dissolution of the one in the other. The packaging according to the invention therefore guarantees the preparation of a product of desired composition and, in the particular case of medicinal or pharmaceutical products, with a preset content of active ingredients, so as to observe the dosage set for patient therapy.

The packaging according to the invention is, finally, practical and easy to use and requires no particular effort on the part of users.

The invention thus conceived is susceptible of numerous modifications and variations, all of which falling within the scope of the inventive concept.

Furthermore all the details can be replaced with others that are technically equivalent.

In practice, the materials used, as well as the shapes and dimensions, may be any according to requirements without because of this moving outside the protection scope of the following claims.

The disclosures of the Italian Patent Application no. MO2005A000058, the priority of which is claimed by this application, are incorporated herein by reference.

The invention claimed is:

1. A packaging for extemporaneous products, comprising:

a container of a first substance which extends into a neck, a mouth defined at the end of the neck facing the outside of the container, and a one-piece receptacle containing a second substance which is at least partially housed in and in direct contact with said neck, an inner volume of the receptacle being temporarily separated from an inner volume of the container and adapted to be placed in communication with the inner volume of the container for mixing the first and second substances to form a product, wherein said receptacle comprises a tubular body which has an end, facing the inner volume of said container and closed by a bottom, and an opposite open end, and which is provided with at least one window defined in a side wall thereof, said receptacle being fitted axially sliding in said neck between a containment configuration of the second substance, in which said receptacle is retracted in said neck, which closes said window, and a release configuration of the second substance, in which said receptacle is at least partially protracted beyond an end of the neck facing the inside of the container, with said window at least partially uncovered to allow the fall of the second substance in the container.

2. The packaging according to claim 1, wherein said bottom is inclined with respect to the axis of said tubular body, the perimeter of said bottom having a point of said bottom least distant with respect to the surface of container opposite said bottom and said window having a side extending along a section of said perimeter comprising said point.

3. The packaging according to claim 1, wherein said bottom extends in a tubular shell on opposite side with respect to said tubular body.

4. The packaging according to claim 1, comprising temporary retention means of said receptacle in said containment configuration.

5. The packaging according to claim 4, wherein said temporary retention means comprise at least a first protrusion defined as overhanging on the outer side surface of said tubular body or of said tubular shell and which extends along a plane transversal to the longitudinal axis of said receptacle, said first protrusion being adapted to interfere with the inner side surface of said neck and yielding by flexing following the sliding of said receptacle in said neck.

6. The packaging according to claim 5, wherein said first protrusion is shaped like a ring.

7. The packaging according to claim 1, comprising temporary blocking means of said receptacle in said release configuration.

8. The packaging according to claim 7, wherein said temporary blocking means comprise at least a second protrusion defined as overhanging on the outer side surface of said tubular body and which extends along a plane transversal to the longitudinal axis of said receptacle, said second protrusion being adapted to interfere with the inner side surface of said neck and yielding by flexing following the sliding of the said receptacle in said neck.

9. The packaging according to claim 8, wherein said second protrusion is shaped like a ring.

10. The packaging according to claim 1, wherein:

said bottom extends in a tubular shell on the opposite side compared to said tubular body;

the packaging comprises temporary retention means of said receptacle in said containment configuration, said temporary retention means comprising at least a first protrusion defined as overhanging on the outer side surface of said tubular shell and which extends along a plane transversal to the longitudinal axis of said receptacle, said first protrusion being adapted to interfere with the inner side surface of said neck and yielding by flexing following the sliding of said receptacle in said neck; and the packaging comprises temporary blocking means of said receptacle in said release configuration, said temporary blocking means comprising at least a second protrusion defined as overhanging on the outer side surface of said tubular body near to said open end of said receptacle and which extends along a plane transversal to the longitudinal axis of said receptacle, said second protrusion being adapted to interfere with the inner side surface of said neck and yielding by flexing following the sliding of the said receptacle in said neck.

11. The packaging according to claim 1, wherein the inner side surface of said neck has a truncated cone shape that converges towards the inside of said container.

12. The packaging according to claim 1, wherein said tubular body is substantially cylinder-shaped and with a substantially constant orthogonal section.

13. The packaging according to claim 1, wherein said open end of the receptacle extends beyond said mouth.

14. The packaging according to claim 1, comprising a removable cap which covers said mouth, has a crown and is associated with said container with threaded coupling suitable for screwing up said cap on said container, the inner surface of said crown being associated with said open end of said receptacle, the sliding of said receptacle from said containment configuration to said release configuration being caused by the screwing up of said cap on said container.

15. The packaging according to claim 14, wherein said cap comprises an inner appendix extending from said crown and which fits into said open end of the receptacle.

16. The packaging according to claim 14, wherein said cap comprises a seal ring temporarily fastened to said cap along a breakable line and which is associated with said container.

17. The packaging according to claim 16, wherein said seal ring has an inner diameter greater than the outer diameter of said cap, between said seal ring and said cap a fixing coupling being defined adapted to fix said seal ring and said cap once the cap is completely screwed up.

18. The packaging according to claim 17, wherein said fixing coupling comprises a raised part defined as protruding from the outer side surface of said cap and a corresponding groove defined inside said seal ring.

19. The packaging according to claim 18, wherein:

said cap comprises a liner, substantially cylindrical, open at the opposite ends and able to externally embrace said neck, and a top, which defines said crown and which is temporarily fastened to the surrounding edge of an end of said liner with in between a removable band, the opposite edges of said band being associated with said surrounding edge of the liner and said top along respectively weakened lines; and said raised part is defined in said liner.

20. The packaging according to claim 14, wherein said cap comprises an inner cavity which couples by fixing into a corresponding fastening tooth defined as protruding near said open end of said receptacle, said receptacle being extracted from said neck integral with said cap by the unscrewing of the latter.

21. The packaging according to claim 14, wherein said cap comprises a liner, substantially cylindrical, open at the opposite ends and able to externally embrace said neck, and a top, which defines said crown and which is temporarily fastened to the surrounding edge of an end of said liner with in between a removable band, the opposite edges of said band being associated with said surrounding edge of the liner and said top along respectively weakened lines.

22. The packaging according to claim 1, wherein said receptacle comprises a handgrip defined on the outer side surface of said receptacle and near to said open end.

* * * * *

UNITED STATES PATENT AND TRADEMARK OFFICE

CERTIFICATE OF CORRECTION

PATENT NO. : 8,387,786 B2
APPLICATION NO. : 11/886034
DATED : March 5, 2013
INVENTOR(S) : Antonio Fontana It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1525 days.

Signed and Sealed this
First Day of September, 2015

Michelle K. Lee

Michelle K. Lee
*Director of the United States Patent and Trademark Office*